US006983699B1

(12) United States Patent
Gold et al.

(10) Patent No.: US 6,983,699 B1
(45) Date of Patent: Jan. 10, 2006

(54) EXPLOSIVE FRAGMENTATION MUNITION

(75) Inventors: Vladimir Gold, Hillside, NJ (US); Ernest L. Baker, Wantage, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 11/011,022

(22) Filed: Dec. 3, 2004

Related U.S. Application Data

(63) Continuation of application No. 10/249,479, filed on Apr. 14, 2003, now abandoned.

(60) Provisional application No. 60/320,027, filed on Mar. 20, 2003.

(51) Int. Cl.
*F42B 12/22* (2006.01)
*F42B 12/24* (2006.01)
*F42B 12/32* (2006.01)

(52) U.S. Cl. ..... 102/495; 102/494; 102/496

(58) Field of Classification Search ..... None

See application file for complete search history.

(56) References Cited

U.S. PATENT DOCUMENTS 4,807,795 A * 2/1989 LaRocca et al. ..... 228/107
4,850,260 A * 7/1989 Walker et al. ..... 89/34

* cited by examiner

*Primary Examiner*—Michael J. Carone
*Assistant Examiner*—Bret Hayes
(74) *Attorney, Agent, or Firm*—Michael C. Sachs; John F. Moran

(57) ABSTRACT

An explosive fragmentation munition having a longitudinal axis which includes a cylindrical shell portion having a thickness and an interior; a rounded shell portion having a thickness and an interior, the rounded shell portion being disposed at a front end of the cylindrical shell portion; an explosive disposed in the interiors of the cylindrical shell portion and the rounded shell portion; wherein the thickness of the rounded shell portion equals the thickness of the cylindrical shell portion where the rounded shell portion joins the cylindrical shell portion, and wherein the thickness of the rounded shell portion increases in a forward direction along the longitudinal axis.

12 Claims, 6 Drawing Sheets

EXPLOSIVE FRAGMENTATION MUNITION

CROSS REFERENCE TO RELATED APPLICATIONS

This application is a continuation of application Ser. No. 10/249,479 as originally filed on Apr. 14, 2003, now abandoned by Vladimir Gold et al. for "Explosive Fragmentation Munition", which itself claims the benefit under 35USC119 (e) of U.S. Provisional Application No. 60/320,027 filed Mar. 20, 2003, the entire file wrapper contents of which applications are hereby incorporated by reference herein as though fully set forth at length.

FEDERAL RESEARCH STATEMENT

[The inventions described herein may be manufactured, used and licensed by or for the U.S. Government for U.S. Government purposes.]

BACKGROUND OF INVENTION

The invention relates in general to explosive fragmentation munitions and, in particular, to an explosive fragmentation munition with improved fragment distribution.

The principal rationale for the airburst fragmentation warhead technology is to optimize the efficiency of the fragment spray dispersion pattern by detonating the round in the air at location near the target. The technical feasibility of the airburst warhead technology is largely due to recent advances in the state-of-the-art electronics that make possible fabrication of miniaturized fuzes with improved "intelligence" and reliability, enabling the round to assess its position at the predetermined location within approximately +5 meters from the target. In addition, the onboard "intelligence" of the fuze will enable the munition to function in a number of modes, including the airburst mode, the point impact mode, and the delayed initiation mode. A brief description of the novel Airburst Explosive Fragmentation Shell with Superior Anterior Fragment Distribution presented here is as follows.

BRIEF DESCRIPTION OF DRAWINGS

In the drawings, which are not necessarily to scale, like or corresponding parts are denoted by like or corresponding reference numerals.

FIG. 2 shows the fragmenting shell (21, 23), having explosive 20 within, but with a fragmenting anterior liner 22 surrounding a pusher liner 24; a closeup of the shell ogive is shown in FIG. 3C; a side view of the shell; and then shell 25 with pusher liner 27, and a fragmenting anterior liner 28.

The two images FIGS. 3A, 3C represent computed images of these two munitions after the explosives are detonated and the metal shells are about to break up ejecting a spray of fragments into the air; FIGS. 3B and 3D respectively are polar graphs showing results of idealized analyses of the probability of incapacitation in the area of the explosive burst. The spray pattern 41, 43 of bat wings 31, 33 is shown in the graph of FIG. 3B. The spray pattern 45 is shown in FIG. 3D, representing the effect of particles formed as 35 in FIG. 3C. As shown in the graphs, the lethal area of the munition of FIG. 2C is more than four times that of the baseline munition of FIG. 2A, predominantly due to the Super Anterior Fragment distribution pattern thereof 35 filling the entire front space between the two bat-wings (31, 33) with fragments.

DETAILED DESCRIPTION

Figure 1A:
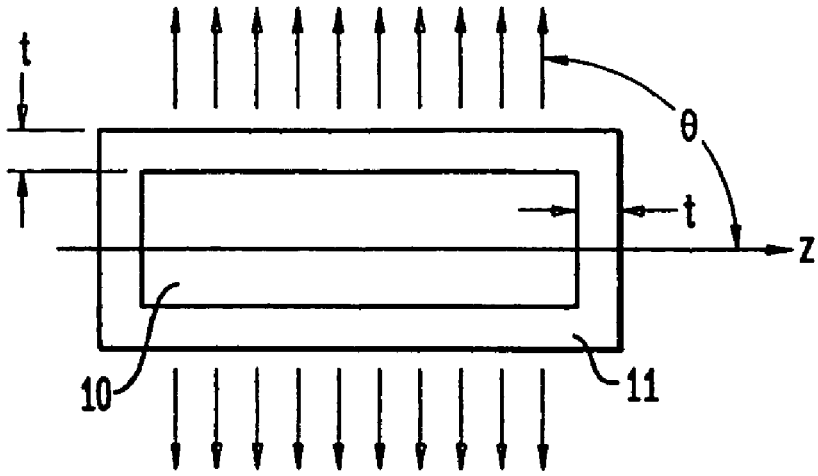
FIG. 1A shows an idealized geometry for the airburst explosive fragmentation shell; it shows an idealized cylindrical fragmenting shell 11 of uniform thickness t, and including explosive 10 within.
Figure 1B:
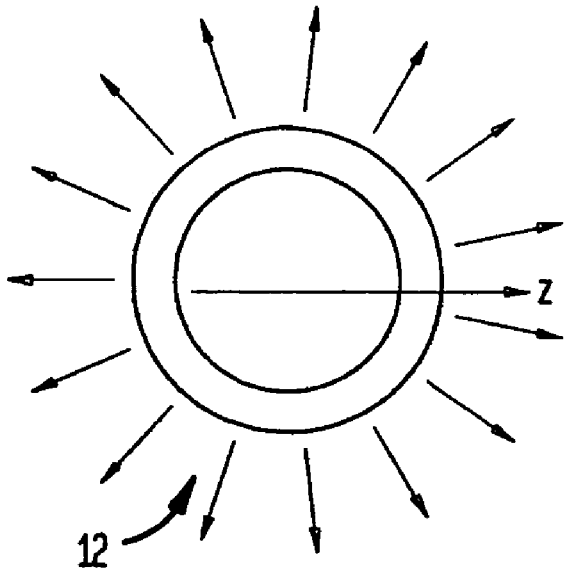
FIG. 1B shows the fragment spray pattern 12 of such idealized cylindrical shell device.
Figure 1C:
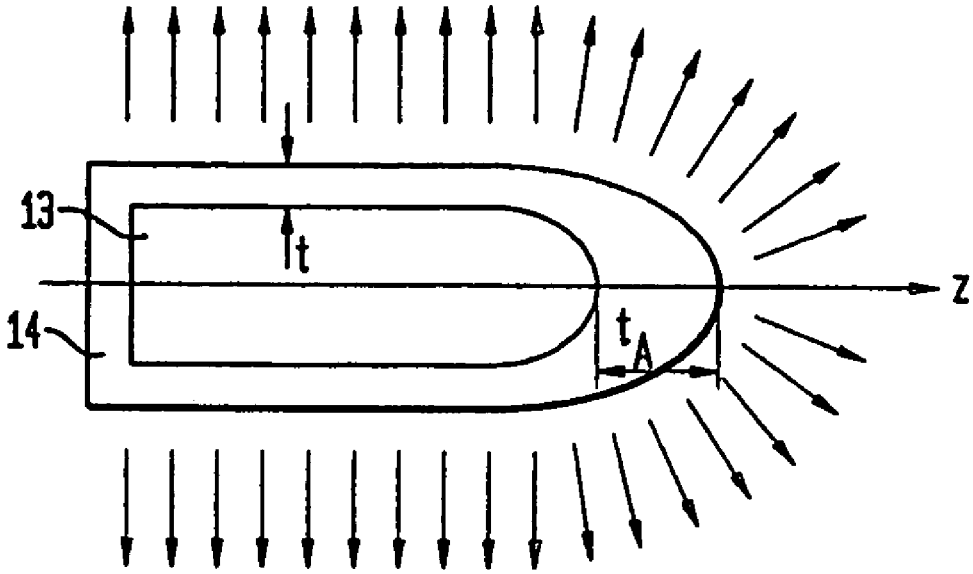
FIG. 1C shows the fragment spray pattern cross-sectionally viewed, of a cylindrical shell device 14 of wall thickness t but front ogive portion having thickness $t_A$ at its tip and thicknesses tapering down to t at the walls of the cylinder, and having explosive 13 within such shell device.

Examples of possible idealized geometries for the airburst explosive fragmenting shell are shown in FIG. 1. Upon initiation of the high explosive charge, rapid expansion of high-pressure high-velocity detonation products results in high-strain, high-strain-rate dilation of the metal shell encapsulating the explosive, which eventually ruptures generating a "spray" of high-velocity fragments moving with trajectories at angles Θ with the z-axis. Accordingly, the principal lethality parameter of the explosive fragmenting shell is the number of fragments as a function of the angle Θ, which determines the statistical probability of incapacitation of the target and, ultimately, the overall efficiency of the munition. Assuming that the changes in the trajectories of the fragments due to the air resistance are negligible, the angular distribution of the fragment spray is a function of the initial geometry of the fragmenting shell's surface, the strength, the density, and the thickness thereof.

For example, in the case of an idealized cylindrical shell of uniform thickness t, FIG. 1 (*a*), the available shell mass at the ends is relatively small, and, therefore, only a small number of fragments will be ejected into the anterior region of the munition target space. Thus, since the bulk of the fragment spray is ejected predominantly in the direction normal to the z-axis, the effectiveness of cylindrical airburst shells is relatively low. On the other hand, in the case of an idealized spherical shell of the same mass, FIG. 1 (*b*), the fragment spray distribution pattern at the quasi-static burst conditions is nearly perfect, but, unfortunately, the concept is impractical for gun-launched munition applications, mostly because of the projectile design constraints including payload-to-gun caliber ratio, and projectile stability. In addition, high terminal projectile velocities tend to degrade the penetration capability of fragments ejected from the posterior portion of the shell, thereby reducing the warhead lethal area by approximately a factor of two compared to that at quasi-static burst conditions.

Figure 2A:
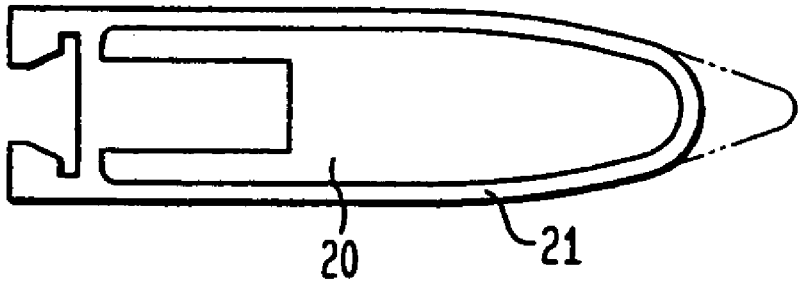
FIGS. 2A–2C show
Figure 2B:
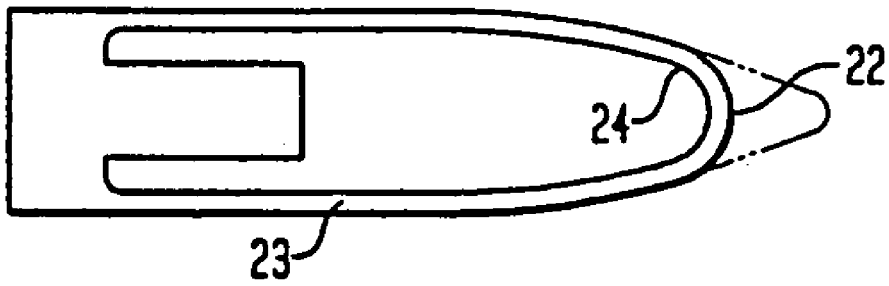
Figure 2C:
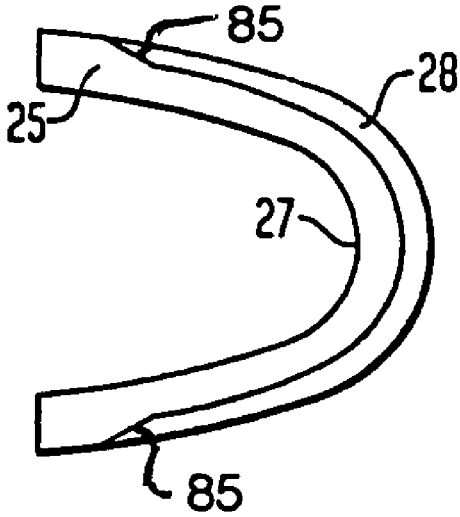
Figure 3A:
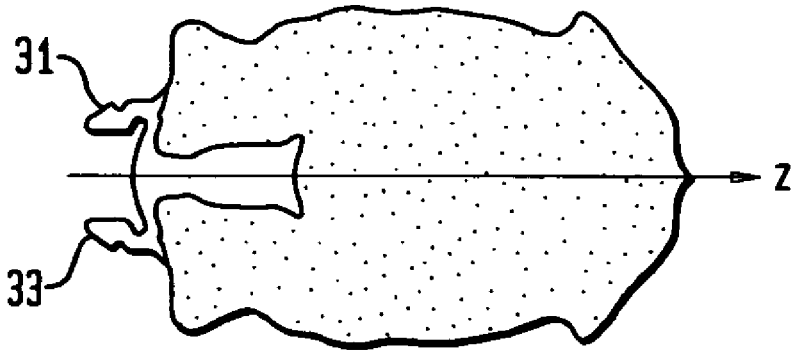
FIGS. 3A–3D results of analyses of fragmentation patterns of two viable embodiments of the invention: baseline fragmenting shell of FIG. 2A in FIGS. 3A and 3B; and a Composite fragmenting shell FIG. 2C, in FIGS. 3C and 3D.
Figure 3B:
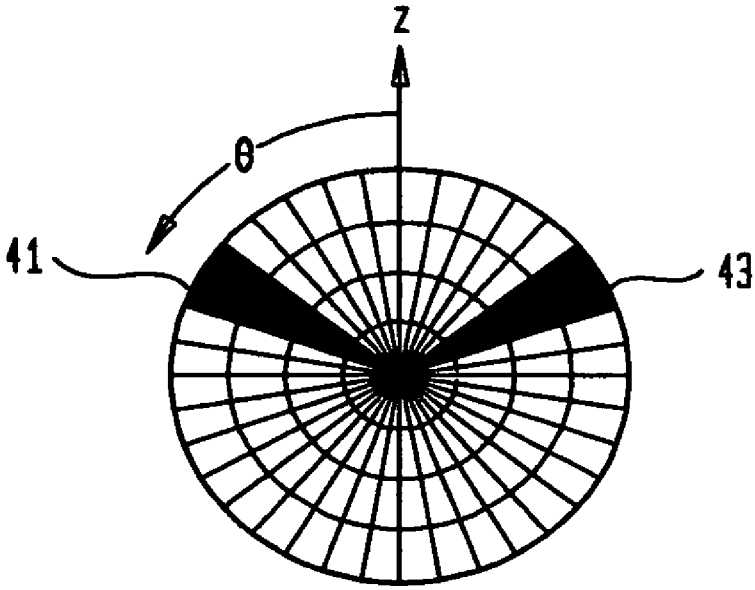
Figure 3C:
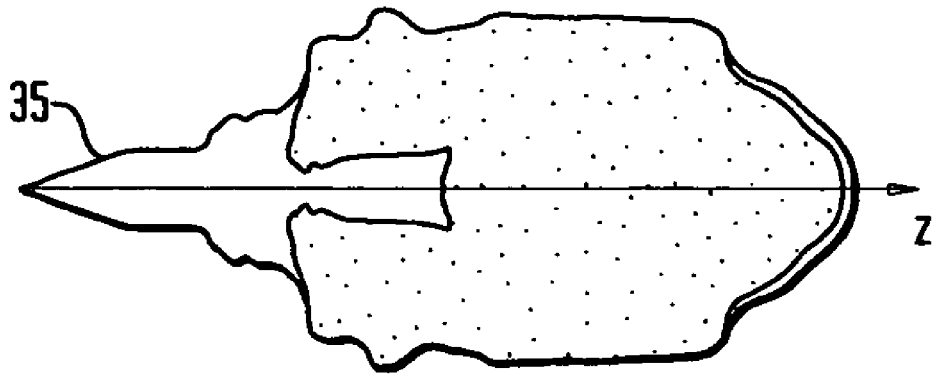
Figure 3D:
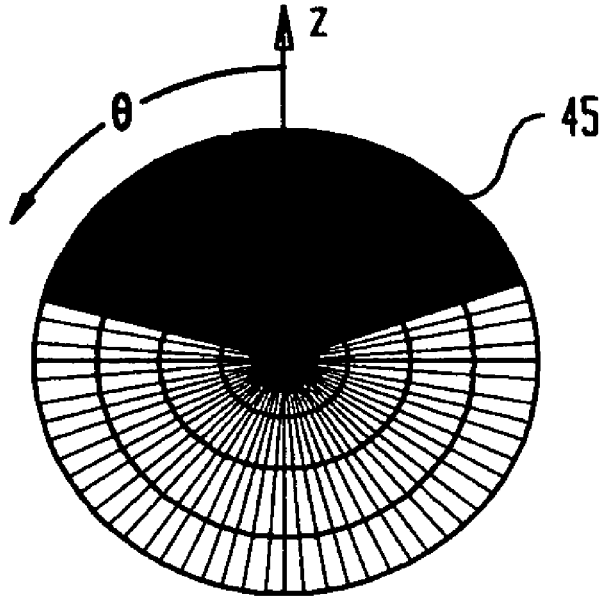

An alternate approach for a solution to the problem is shown in FIG. 1 (*c*) whereas the ogive front portion of the shell is thickened and rounded. Thickening and rounding the front portion of the shell enables generating a fixed number of fragments per unit length of the shell and per unit angle Θ of the target space, which integrates the best features of the two idealized geometries of FIGS. 1 (*a*) and 1 (*b*) and maximizes warhead lethality. As shown in FIGS. 2 and 3, the embodiment of a munition of FIG. 1 (*c*) can be further extended to that of a Composite Fragmenting Shell, enabling even greater lethality than that of the single material approach.

The Composite Fragmenting Shell embodiment of the munition is shown in FIGS. 2(*b*) and 2(*c*). As shown in the figures, the cylindrical portion of the fragmenting shell encapsulates the explosive from the sides and generates fragment spray in the direction normal to the z-axis, while the front portion serves as a "pusher" to transfer the momentum to the Anterior Fragmenting Liner that projects fragments to the front. In order to optimize preferred fragment size distribution, the Anterior Liner could be comprised of two or more layers of liners stacked to each other. Since in order to generate an approximately fixed number of fragments per unit length of the shell requires significant amount of the shell mass in the front, the Anterior Liner has to be fabricated from a high-density material. Accordingly, a material of choice for the Fragmenting Anterior Liner is tungsten, mostly because of the high density and strength properties. However, the Anterior Liner could also be made from a variety of high-density metals and metal alloys including tantalum, lead, and depleted uranium. The Anterior Liner could be fabricated with surface patterns of scores to produce preferred fragment sizes, or could be comprised of preformed high-density fragments imbedded in a different matrix material.

Another rationale for using high-density high-strength metals and metal alloys is the superior penetration efficiency of these materials, enabling generation of larger numbers of lethal fragments per unit fragmenting shell mass and significantly increasing the warhead lethality. In order to avoid premature rupture of the shell and leakage of the detonation products, the end of the Fragmenting Anterior Liner is tapered, smoothly blending with the main fragmenting shell. As shown in FIG. 3, a proper taper of the liner is a key factor for maximizing the efficiency of the warhead.

Since the round may have to withstand high-G gun-launch loads, a material of choice for the main fragmenting shell is high-strength steel. Since the Anterior Liner rests on the main fragmenting shell, the G-load stresses there are small, and, therefore, the preferred fragmentation mode for the Anterior Liner is controlled fragmentation. FIG. 3 show an assessment of the effectiveness of two preferred embodiments of the munition by taking into account a complex battlefield scenario including the number and positions of the soldiers, the soldiers posture, the combined effects of the helmet, the body armor as well as unprotected portions of the body, resulting in a prediction of high probability of serious or lethal wounds for the entire body. The input for the lethality analyses included the fragment velocity and mass distribution from continuum analyses, plus projectile terminal ballistic parameters at the given range, including warhead velocity at burst, orientation of warhead, the height of burst, and other factors. As shown in FIG. 3, assuming ideal fragmentation (0% losses) of the anterior liner, the expected lethal area of the Composite Fragmenting Shell concept is approximately 4 to 8 times greater that of the FIG. 1 (*c*) baseline concept.

Figure 4:
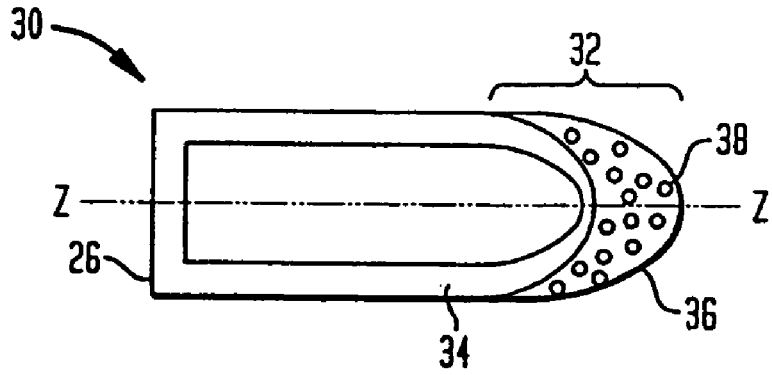
FIG. 4 is a schematic sectional view of another embodiment of a munition according to the invention.

FIG. 4 is a schematic sectional view of another embodiment of a munition 30 according to the invention. Munition 30 is similar to munition 22, except the rounded shell portion 32 includes two layers 34, 36. The first layer 34 comprises the same material as the cylindrical shell portion 26. The second layer 36 is disposed on an outer surface of the first layer 34. The second layer comprises matrix material holding fragments 38 disposed therein. The fragments may be made of a high density, high strength material such as tungsten, tantalum, or depleted uranium that are also suitable for second layer 36. The fragments 38 may be shaped, for example, as spheres, cubes or other shapes. The second layer 36 is attached to the first layer 34 by, for example, an adhesive or shrink fitting.

Figure 5:
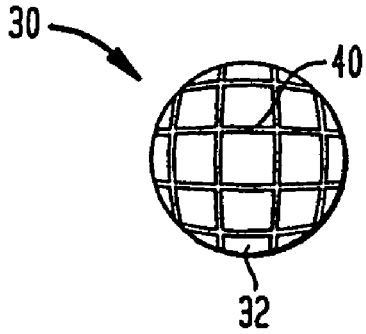
FIG. 5 is a front view of the munition of FIG. 4.

FIG. 5 is a front view of the munition 30 of FIG. 4. FIG. 5 shows scoring 40 (for example, grooves) in the second layer 38 of the rounded shell portion 32. The surface pattern of scores helps to produce preferred fragment sizes.

Figure 6:
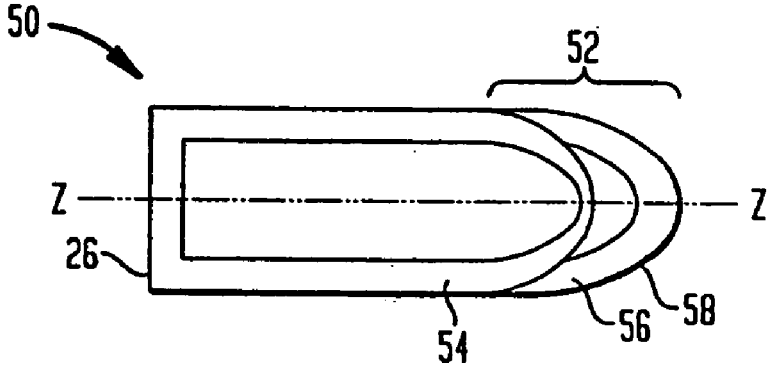
FIG. 6 is a schematic sectional view of another embodiment of a munition according to the invention.

FIG. 6 is a schematic sectional view of another embodiment of a munition 50 according to the invention. Munition 50 is similar to munition 30, except the rounded shell portion 52 includes three layers 54, 56, 58. The first layer 54 comprises the same material as the cylindrical shell portion 26. The second layer 56 is disposed on an outer surface of the first layer 54. The third layer 58 is disposed on the outer surface of the second layer 56. The material of the second layer 56 may be the same as or different than the material of the third layer 58. The material of the second and third layers 56, 58 may be, for example, a high density, high strength material such as tungsten, tantalum, or depleted uranium. FIG. 6 has been drawn with an exaggerated nose area where the widths are out of actual proportion; the purpose is only to better illustrate the various layers in the nose cone, however the nose cone shown in FIG. 2 is more nearly the actual proportion.

Either or both of the second and third layers 56, 58 may have fragments disposed therein, in a similar fashion as shown with reference to layer 36 in FIG. 4. The second layer 56 is attached to the first layer 54 and the third layer 58 is attached to the second layer 56 by, for example, an adhesive or shrink fitting. Third layer 58 may also be scored, as discussed above with reference to layer 36 of FIG. 5.

While the invention has been described with reference to certain preferred embodiments, numerous changes, alterations and modifications to the described embodiments are possible without departing from the spirit and scope of the invention as defined in the appended claims, and equivalents thereof.

The invention claimed is:

1. An explosive fragmentation munition having a longitudinal axis, comprising:

a single-layered, generally cylindrical shell portion having a thickness;

an exposed rounded nose having a thickness, the nose being disposed at a front end of the cylindrical shell portion;

an explosive disposed inside the cylindrical shell portion and the nose;

wherein the nose includes a pusher liner that is made of a similar material as the cylindrical shell portion, and a multi-layered anterior liner that is disposed on an outer surface of the pusher liner; and wherein the multi-layered anterior liner is made of a high-density material that is different from the material of the cylindrical shell portion and that adds mass to the nose, so that the pusher liner transfers momentum to the anterior liner, which, in turn, projects fragments in a forward direction.

2. The munition of claim 1 wherein the anterior liner contains preformed fragments disposed therein.

3. The munition of claim 1 wherein the anterior liner includes scoring on an outer surface thereof.

4. The munition of claim 1 wherein the material of the pusher liner is steel.

5. The munition of claim 1 wherein the anterior liner is made at least in part of tungsten alloy and contains preformed fragments embedded in an alloy matrix.

6. The munition of claim 1 wherein the anterior liner comprises at least a first layer made of a material that is selected from the group consisting of tungsten, tantalum, hafnium, and depleted uranium alloys.

7. The munition of claim 6 wherein the multi-layered anterior liner comprises a second layer that is made of a material selected from the group consisting of tungsten, tantalum, hafnium, and depleted uranium alloys.

8. The munition of claim 1, wherein the cylindrical shell portion has a generally uniform thickness.

9. The munition of claim 7 wherein the anterior liner comprises a third layer that is stacked on the second layer.

10. The munition of claim 9 wherein the third layer is made of a material that is selected from the group consisting of tungsten, tantalum, hafnium, and depleted uranium alloys.

11. The munition of claim 10 wherein the anterior liner contains fragments disposed therein, intermediate the first layer and the second layer.

12. The munition of claim 1 wherein the munition contains no plastic material.

* * * * *